US006280240B1

(12) United States Patent
Chang

(10) Patent No.: US 6,280,240 B1
(45) Date of Patent: Aug. 28, 2001

(54) FLEXIBLE PRINTED CIRCUIT CONNECTOR WITH AN IMPROVED SLIDER

(75) Inventor: Jen Jou Chang, Yung-Ho (TW)

(73) Assignee: Hon Hai Precision In.D Co., Ltd., Taipei Hsien (TW)

( * ) Notice: Subject to any disclaimer, the term of this patent is extended or adjusted under 35 U.S.C. 154(b) by 0 days.

(21) Appl. No.: 09/697,878

(22) Filed: Oct. 26, 2000

(30) Foreign Application Priority Data

Sep. 1, 2000 (TW) ..... 089215211

(51) Int. Cl.[7] ..... H01R 12/24
(52) U.S. Cl. ..... 439/495
(58) Field of Search ..... 439/260, 492, 439/493, 495, 325, 329

(56) References Cited

U.S. PATENT DOCUMENTS 5,354,214 * 10/1994 Aso et al. ..... 439/495
5,882,223 * 3/1999 Igarashi ..... 439/495
5,906,504 * 5/1999 Igarashi et al. ..... 439/495
6,165,008 * 12/2000 Wu et al. ..... 439/495

* cited by examiner

*Primary Examiner*—Tho D. Ta
(74) *Attorney, Agent, or Firm*—Wei Te Chung

(57) ABSTRACT

A flexible printed circuit connector (1) includes a substantially rectangular housing (10), a plurality of terminals (20) received in the housing, a slider (40) and a pair of solder pads (30). The slider has a pair of ribs (404) at each side thereof, and a protrusion (411) downwardly formed at a rear end thereof for movement between an open position wherein a FPC (5) is free to be inserted into the housing and a closed position wherein the slider biases the FPC against terminals. Each solder pad has an L-shaped rear part (303) mounted in the housing and a C-shaped front part (305) receiving a rib of the slider. The front part forms a vertical front arm (307), and the rear part forms a vertical rear arm (302) spaced a distance apart and offset from the front arm.

12 Claims, 6 Drawing Sheets

FLEXIBLE PRINTED CIRCUIT CONNECTOR WITH AN IMPROVED SLIDER

FIELD OF THE INVENTION

The present invention generally relates to an electrical connector and, more particularly, to a zero insertion force electrical connector for terminating a flexible printed circuit or the like.

BACKGROUND OF THE INVENTION

A wide variety of flexible printed circuit (FPC) connectors are presently used in different environments. One prior artFPC connector is disclosed in U.S. Pat. No. 5,904,586. In this prior artpatent, a pressure member is turned upwardly about a pair of holding sections to an open position to expose the opening of the connector housing, and a flexible board is put into a space between the pressure member and contact elements. Then, the pressure member is turned downwardly to a closed position in which contact elements electrically connect with the flexible board.

The '586 patent requires that the pressure member be turned perpendicularly relative to the housing at the open position. This requirement makes the connector inefficient to operate. Furthermore, this operating configuration causes the connector to occupy a large operating space, which is counter to the trend toward miniaturization of electronic devices. Finally, the holding sections are relatively weak components, which are easily damaged during the operation of the connector, and therefore can result in a malfunction of the connector.

Hence, an improved FPC connector is needed to overcome the above-mentioned deficiencies of current FPC connectors.

SUMMARY OF THE INVENTION

An object of the present invention is to provide an improved flexible printed circuit (FPC) connector which has a slider turning relative to a housing thereof for facilitating insertion of a flexible printed circuit (FPC).

Another object of the invention is to provide an improved slider which does not use holding sections to securely fix the FPC into the FPC connector.

A further object of the invention is to provide an improved solder pad for firmly welding an electrical connector to a circuit board.

An FPC connector of the present invention comprises a substantially rectangular housing, a plurality of terminals received in the housing, a slider and a pair of solder pads mounted on two sides of the housing for welding the FPC connector to a circuit board.

The slider comprises a pair of manual portions and a pair of ribs formed along opposite sides thereof for engaging the slider with the housing and an elongated pressure plate between the manual portions and ribs for biasing an inserted FPC against the terminals. Each rib forms a locking portion at a front thereof and a leading portion at a rear of the locking portion. Each locking portion downwardly forms a protrusion at a rear end thereof for movement between the open position allowing the FPC to be freely inserted and a closed position pressing the FPC against the terminals.

Each solder pad comprises a C-shaped front part and an L-shaped rear part offset and spaced a distance apart from the front part. The front part has a top arm and a front base, and the rear part has a rear base integrated with and in a common plane with the front base.

When the FPC is inserted into the FPC connector, the slider must be in an open position. At the open position, a lower edge of each protrusion abuts the rear base of a corresponding solder pad. The slider rotates downwardly for facilitating insertion of the FPC into the housing. The slider is fastened at the leading portion by the clamping of the front base and the top arm.

When the FPC is fully inserted into the FPC connector, the slider is moved to a closed position. The protrusions engage with a rear end of the rear base of the solder pads at the closed position. The slider biases the FPC against the terminals and is fastened at the locking portions by the clamping of the front base and the top arm, thus the FPC is secured.

Other objects, advantages and novel features of the invention will become more apparent from the following detailed description when taken in conjunction with the accompanying drawings.

DETAILED DESCRIPTION OF THE EMBODIMENT

Reference will now be made in greater detail to the preferred embodiment of the present invention.

Figure 1:
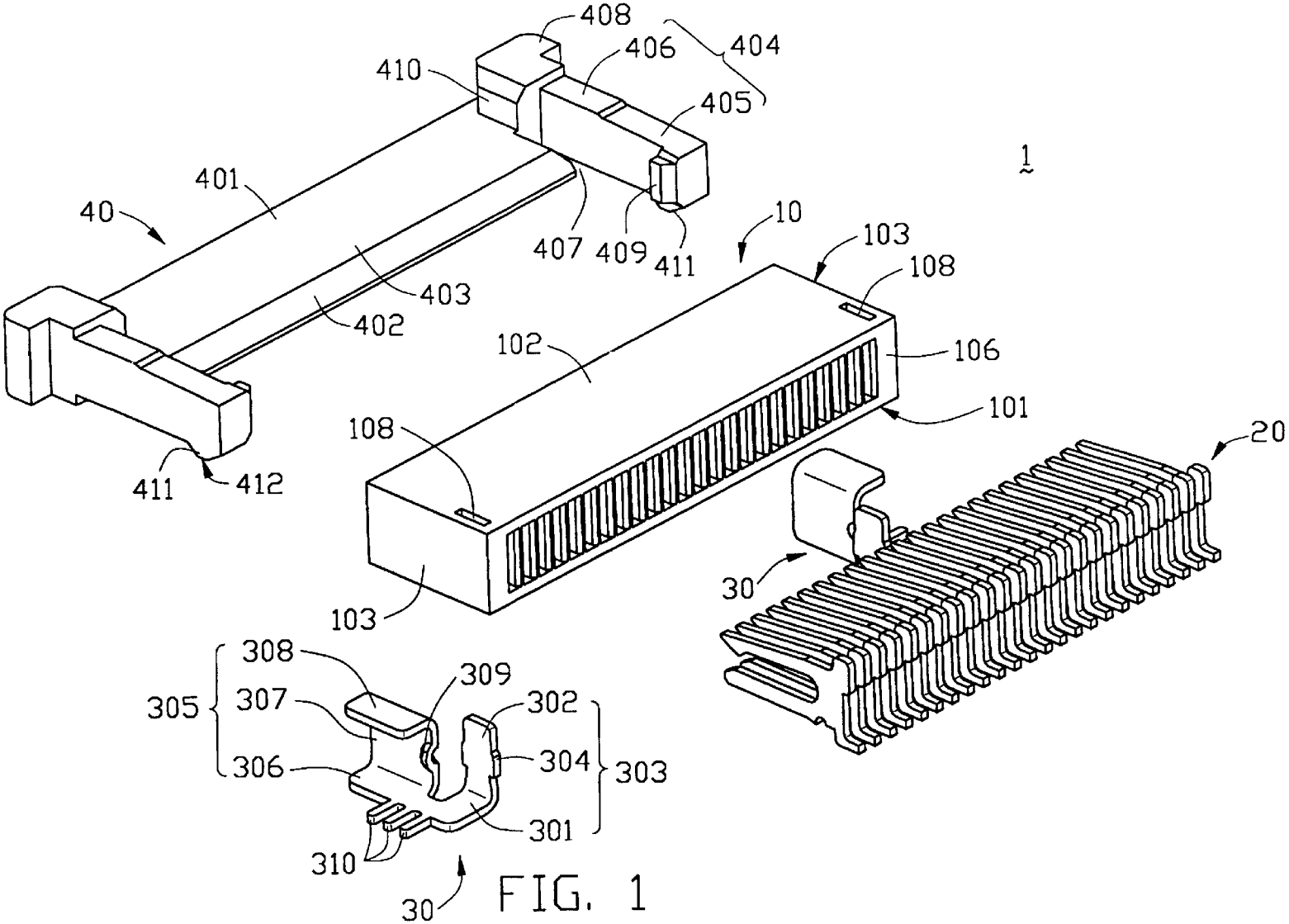
FIG. 1 is an exploded view of an electrical connector in accordance with the present invention.
Figure 2:
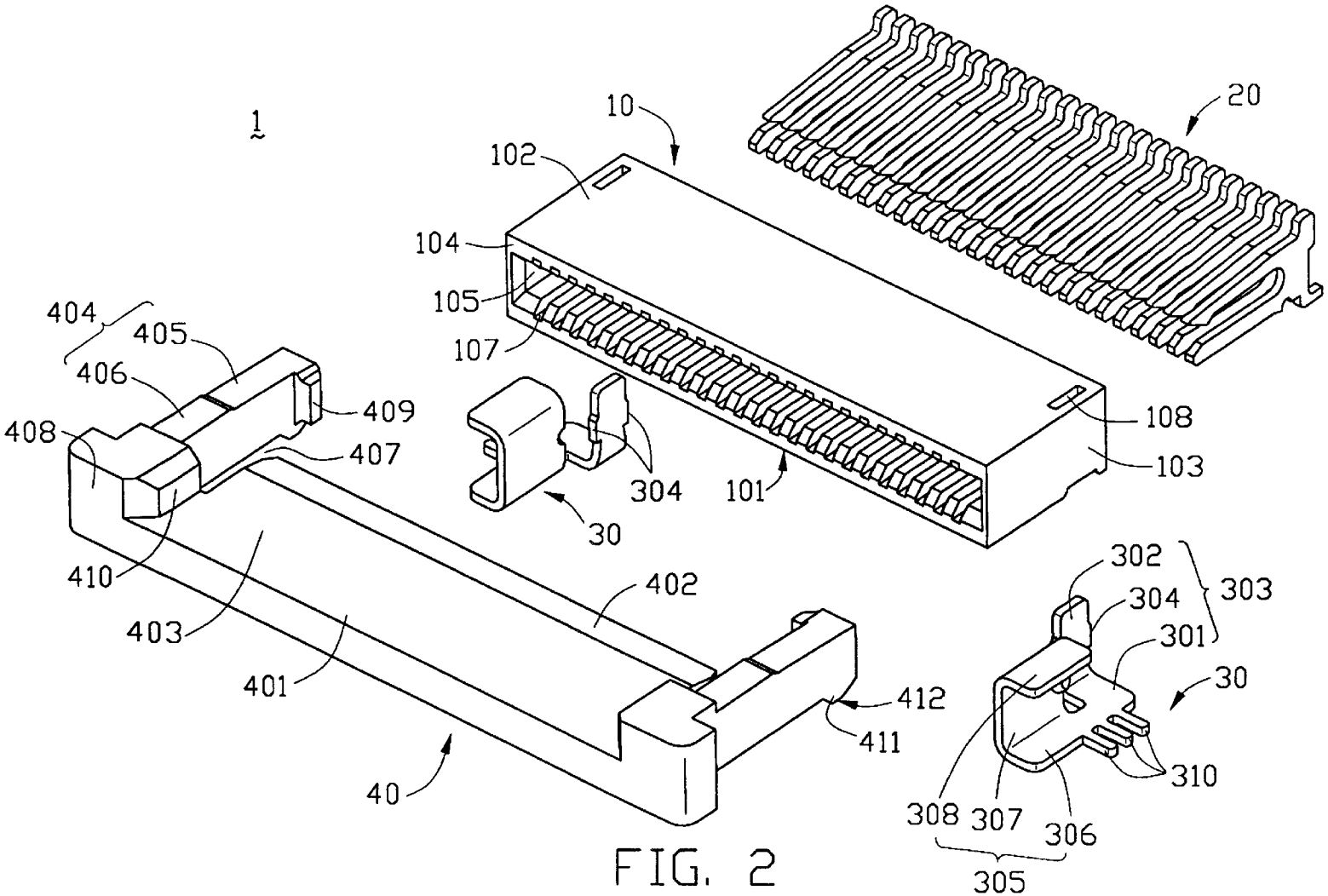
FIG. 2 is a view of the electrical connector of FIG. 1 from another aspect.

Referring to FIGS. 1–2, a flexible printed circuit (FPC) connector 1 in accordance with the present invention includes a substantially rectangular housing 10, a plurality of terminals 20, a slider 40 and a pair of solder pads 30.

The housing 10 includes an elongated bottom wall 101 and an elongated top wall 102 parallel to each other, a pair of sidewalls 103 opposite to each other, a rear wall 106 and a front wall 104. A hollow portion 105 is defined in the housing 10 through the front wall 104 for receiving an end of a flexible printed circuit (FPC) 5 therein. A plurality of passageways 107 is defined in inner surfaces (not labeled) of the bottom and top walls 101, 102 and through the rear wall 106 in communication with the hollow portion 105 for receiving the terminals 20. A pair of slots 108 is defined through the top wall 102 and the bottom wall 101 and near the sidewalls 103.

The slider 40 is unitarily formed and includes an elongated main body 401, a pair of manual portions 408 on opposite sides of the main body 401 and a rib 404 rearwardly extending from a rear face of each manual portion 408 for engaging the slider 40 with the housing 10.

The main body 401 has a substantially planar pressure plate 403 and an elongated tongue 402 extending rearwardly from the elongated pressure plate 403. The tongue 402 is shaped with a decreasing thickness toward its rear for facilitating insertion into the hollow portion 105 of the housing 10. Each manual portion 408 forms a front boss 410 at an inner side thereof Each rib 404 has a locking portion 406 and a leading portion 405. The locking portion 406 has a top face lower than a top face of the manual portion 408. The leading portion 405 rearwardly extends from a rear face of the locking portion 406 and has a top face lower than the top face of the locking portion 406. Each leading portion 405 forms a rear boss 409 at a front inner surface thereof. A protrusion 411 protrudes downwardly from a distal end of each leading portion 405. The protrusion 411 has a relatively narrow and generally planar lower edge 412 and has a pair of inclined faces (not labeled) on a front and rear sides of the lower edge 412. A pair of openings 407 is respectively defined between the main body 401 and the ribs 404 to receive the sidewalls 103 of the housing 10.

Each solder pad 30 includes a rear part 303 for anchoring onto the housing 10 and a front part 305 for engaging with the ribs 404 of the slider 40. The front part 305 is C-shaped and has a front base 306, a front arm 307 vertically extending from an edge of the front base 306, and a top arm 308 extending from a top of the front arm 307 and parallel to the front base 306 for limiting up-and-down movement of a corresponding rib 404 to be between the front base 306 and the top arm 308. A bump 309 is outwardly stamped on a side of the front arm 307 near the rear part 303. The rear part 303 is L-shaped and has a rear base 301 integrally formed with and lying in a common plane with the front base 306 and a rear arm 302 vertically extending from an edge of the rear base 301. The rear arm 302 is spaced a distance apart from the front part 305 and is offset relative to the front arm 307 for anchoring the solder pad 30 onto the housing 10. A pair of barbs 304 is provided on two sides of the rear arm 302 for locking in the slots 108 of the housing 10. Three welding feet 310 outwardly extend from a side edge of the integral front base 306 and rear base 301 for welding the electrical connector 1 to a circuit board (not shown).

Figure 3:
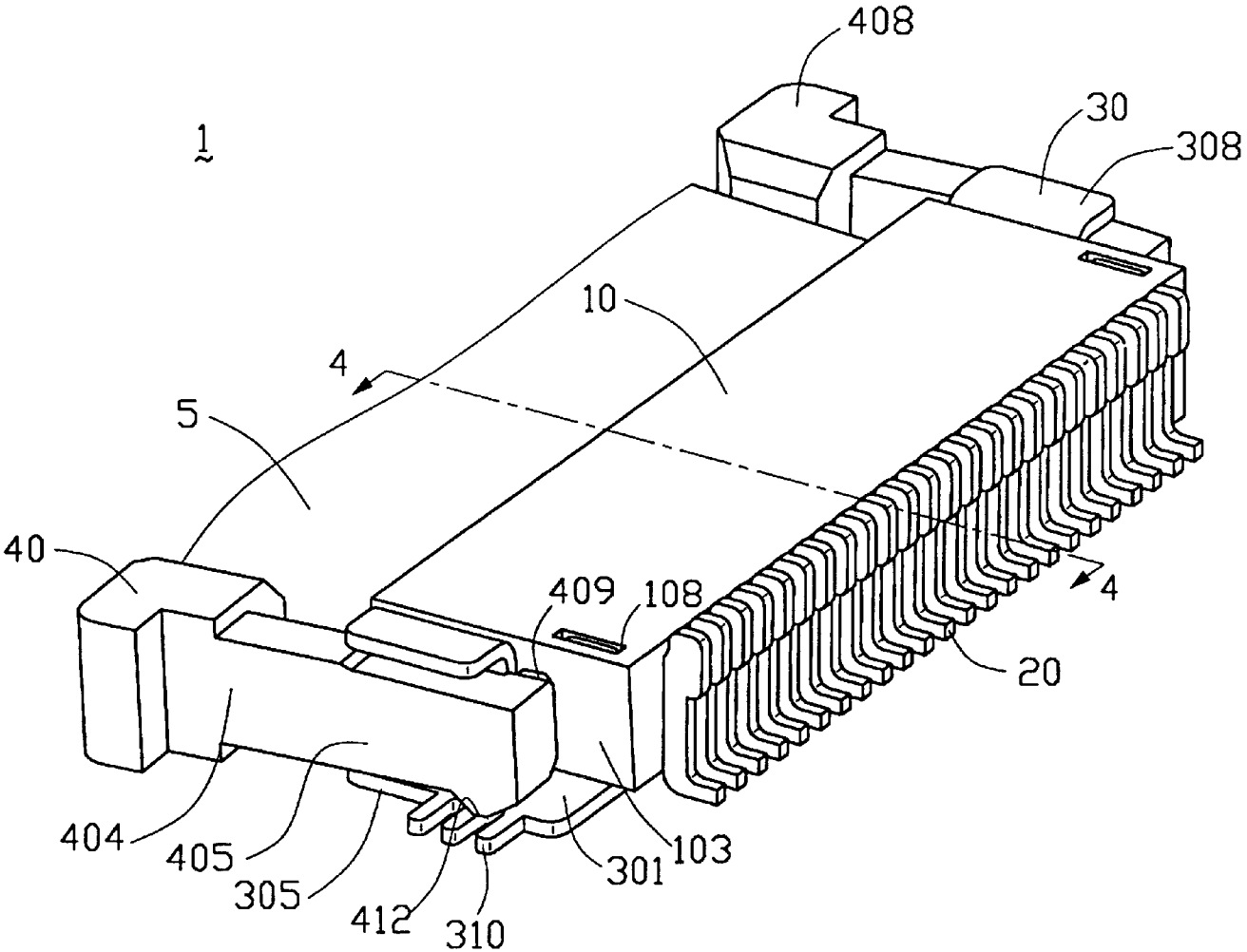
FIG. 3 is an assembled view of FIG. 1, wherein a flexible printed circuit is inserted into the electrical connector at an open position.
Figure 4:
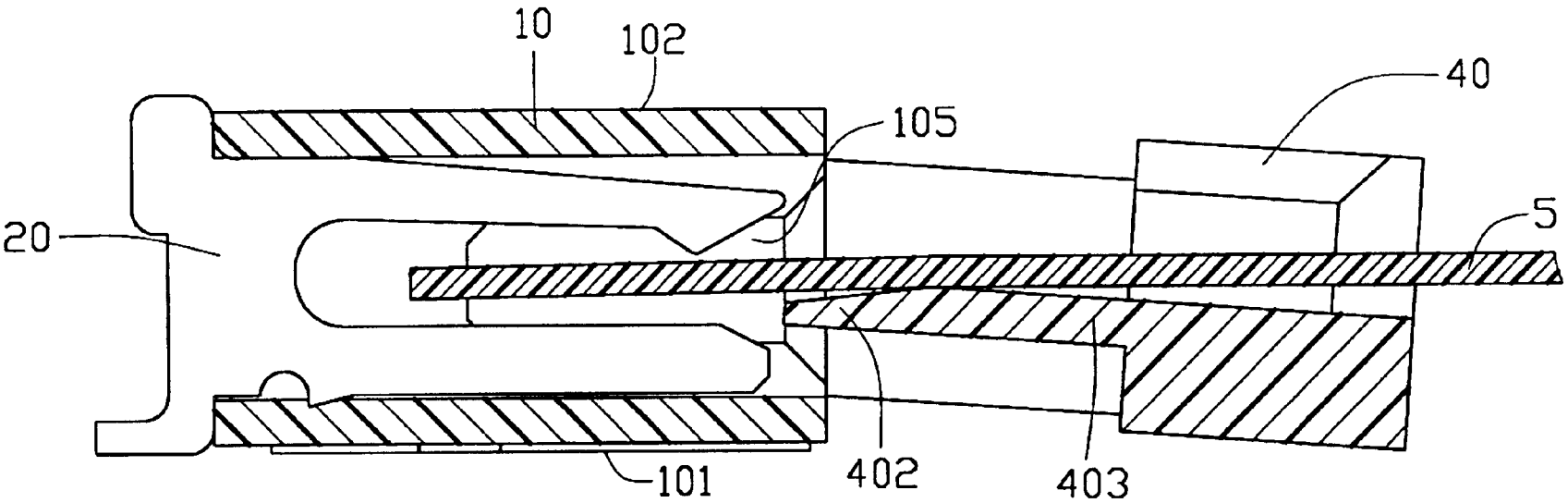
FIG. 4 is a cross-sectional view taken along line 4—4 of FIG. 3.

Referring to FIGS. 3–4, before the FPC 5 is inserted into the FPC connector 1, the slider 40 must be placed in an open position. The ribs 404 of the slider 40 slide forwardly across the front bases 306 of the solder pads 30. The lower edges 412 of the protrusions 411 of the slider 40 press against a top of the rear bases 301 of the solder pads 30. The slider 40 is then rotated downwardly until a junction portion between each lower edge 412 and the adjacent inclined face thereof abuts the top of the corresponding rear base 301, thereby providing an enlarged opening between the slider 40 and the housing 10 for facilitating insertion of the FPC 5 into the hollow portion 105 of the housing 10. A front end of the elongated tongue 402 of the slider 40 is received in the housing 10. Each rear boss 409 latches against the bump 309 of the corresponding solder pad 30 and thus prevents the slider 40 from disengaging from the housing 10. The front base 306 and the top arm 308 retain the slider 40 to the housing 10 by restraining the leading portion 405.At this position, the FPC 5 is not connected with the terminals 20.

Figure 5:
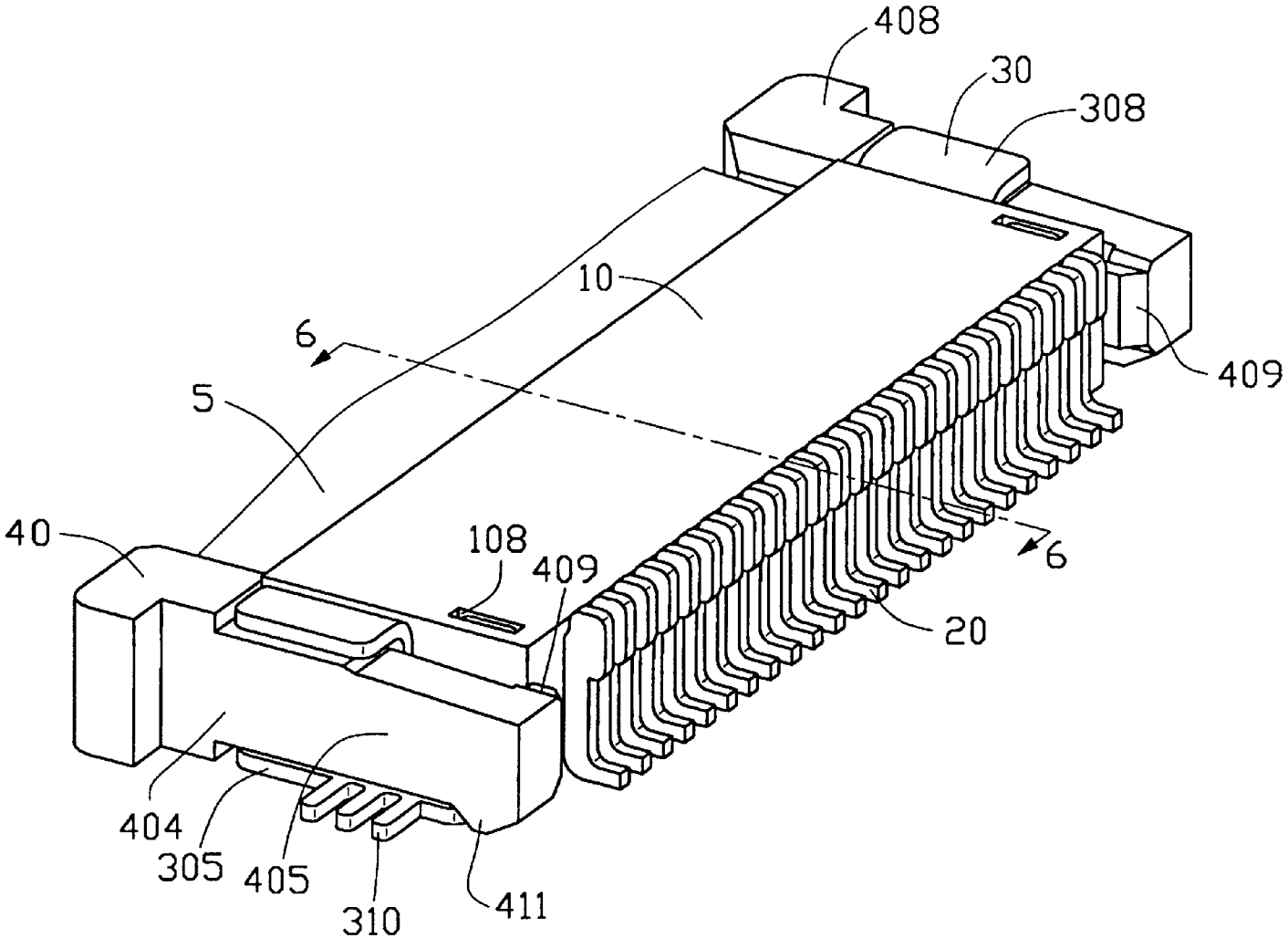
FIG. 5 is similar to FIG. 3, wherein a flexible printed circuit is inserted into the electrical connector at a closed position.
Figure 6:
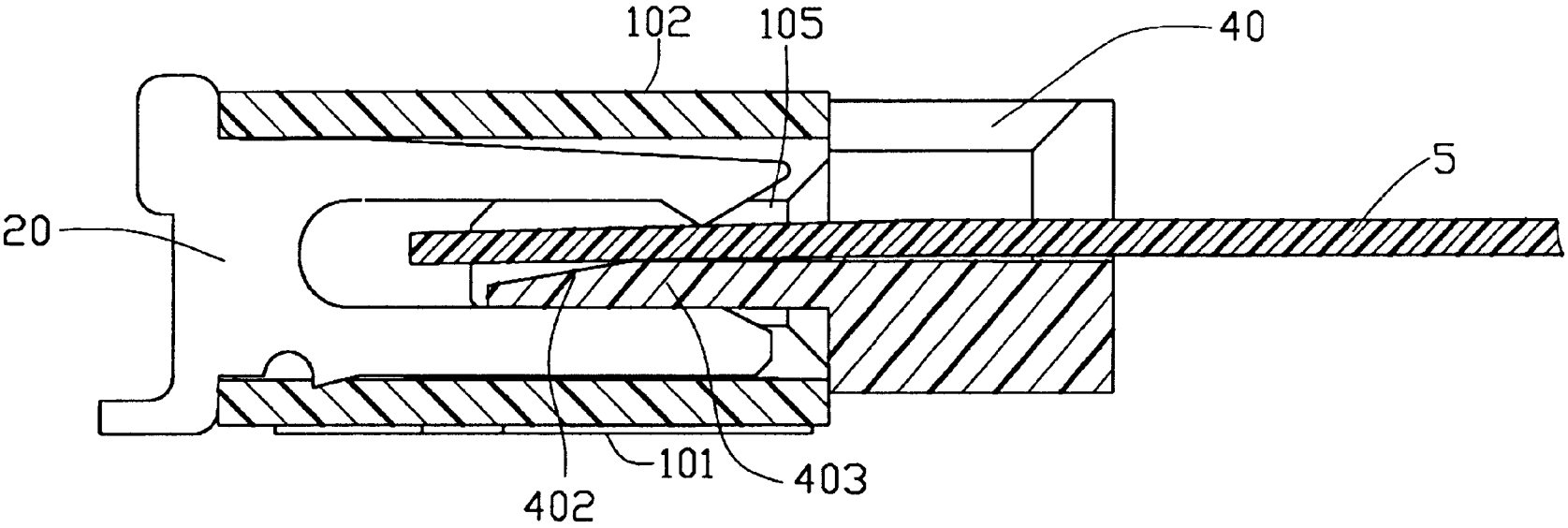
FIG. 6 is a cross-sectional view taken along line 6—6 of FIG. 5.

With reference to FIGS. 5–6, when the FPC 5 is fully inserted into the FPC connector 1, the slider 40 is pushed to a closed position. The slider 40 is rotated and pushed inward into the hollow portion 105 until the lower edge 412 of each protrusion 411 locks over a rear edge of the rear base 301 of the solder pad 30. This is done by an external force exerted rearward against the manual portions 408 to push the ribs 404 of the slider 40 to slide across the rear bases 301 and to force an inclined face of each protrusion 411 to abut a rear edge of the corresponding rear base 301. With the elongated tongue 402 completely received in the hollow portion 105 of the housing 10, the pressure plate 403 is partly received in the hollow portion 105 and biases the FPC 5 against the terminals 20. The front bosses 410 and the rear bosses 409 respectively abut against the front wall 104 and the rear wall 106 for preventing release of the FPC 5 from the housing 10.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector for a flexible printed circuit (FPC), comprising:

a housing defining a hollow portion exposed to a front thereof for receiving an end of the FPC;

a plurality of terminals received in the housing for electrically connecting with the FPC;

a solder pad mounted on the housing and having an integral base adapted for being secured to a circuit board; and a slider movably mounted on the housing and having a pair of ribs rearwardly extending from lateral ends thereof, a protrusion downwardly formed at a rear end of the rib for facilitating movement of the slider between an open position and a closed position; wherein when the slider is in the open position, the protrusion abuts the integral base of the solder pad to thereby provide an enlarged opening between the slider and the housing, whereby the FPC is free to be inserted into the housing, and when the slider is in the closed position, the protrusion engages with a rear edge of the integral base of the solder pad, whereby the slider biases the FPC against the terminals.

2. The electrical connector as claimed in claim 1, wherein said housing has a top wall, a front wall, a bottom wall, a pair of side walls, and a pair of slots defined therethrough from the top wall to the bottom wall near the sidewalls, and wherein the solder pad has a U-shaped portion and a rear arm vertically extending from the rear base and spaced a distance apart from and offset relative to the U-shaped portion for locking in the slot of the housing.

3. The electrical connector as claimed in claim 1, wherein the slider comprises an elongated main body, a pair of manual portions formed on opposite sides of the main body, and a pair of ribs respectively extending rearward from the manual portions for engaging with the housing, and wherein a pair of openings is respectively defined between the main body and the ribs to receive a pair of sidewalls of the housing.

4. The electrical connector as claimed in claim 2, wherein the main body has an elongated pressure plate for pressing the FPC against the terminals when the FPC is fully received in the housing, and an elongated tongue extending rearwardly from the elongated pressure plate and shaped with a decreasing thickness toward a rear of the elongated tongue for facilitating insertion into the hollow portion of the housing.

5. The electrical connector as claimed in claim 3, wherein each rib has a locking portion adjacent to the manual portion and a leading portion rearwardly extending from a rear face of the locking portion, atop face of the leading portion being lower than a top face of the locking portion.

6. The electrical connector as claimed in claim 5, wherein each leading portion and each manual portion respectively form a boss on an inner side thereof for respectively abutting a rear wall and a front wall of the housing when the slider is in the closed position.

7. An electrical connector for a flexible printed circuit (FPC), comprising:

a housing defining a hollow portion exposed to a front thereof for receiving an end of the FPC;

a plurality of terminals received in the housing;

a slider having a pair of ribs formed on opposite sides thereof for engaging with the housing and an elongated pressure plate between the ribs for biasing the FPC against the terminals; and a solder pad mounted on the housing and comprising a front base and a rear base integrally formed in a common plane for welding to a circuit board, a front arm vertically extending from the front base, a top arm extending from the front arm and parallel to the front base, a rear arm vertically extending from the rear base and spaced a distance apart from and offset relative to the front arm for anchoring onto the housing, the top arm and the front base limiting an up-and-down movement of the rib received therebetween.

8. The electrical connector as claimed in claim 7, wherein one or more welding feet projects from a side edge of the solder pad for welding to a circuit board.

9. The electrical connector as claimed in claim 7, wherein a bump is formed on a rear side of the front arm for abutting against a boss of the rib when the slide is at an open position, and a pair of barbs is formed on two sides of the rear arm of the solder pad for securing in the housing.

10. The electrical connector as claimed in claim 7, wherein the slider has an elongated tongue extending rearwardly from the elongated pressure plate for facilitating insertion of the FPC into the housing.

11. The electrical connector as claimed in claim 7, wherein a protrusion is formed at a lower rear end of each rib for engaging a rear edge of the rear base when the slider is at a closed position.

12. An electrical connector for a flexible printed circuit (FPC), comprising:

a housing defining a hollow portion exposed to an exterior;

a plurality of terminals received within the housing for electrically connecting to the FPC;

a pair of solder pads attached to two sides of the housing; and a slider movably mounted to the housing, said slider including a main body received within the hollow portion, and two ribs extending rearwardly by two sides of the main body; wherein each of said solder pads includes retention means for securing to the housing and a U-shaped portion spaced from said retention means and exposed to the exterior whereby each of said ribs moves along the corresponding U-shaped portion and is substantially received therein when the slider is assembled to the housing, each U-shaped portion limits an up-and-down movement of the rib received therein.

* * * * *